US008631516B2

(12) United States Patent
Hofmann

(10) Patent No.: US 8,631,516 B2
(45) Date of Patent: Jan. 21, 2014

(54) HOOD FOR PROTECTIVE GARMENT

(75) Inventor: Marianne Hofmann, Düsseldorf (DE)

(73) Assignee: Blücher GmbH, Erkrath (DE)

( * ) Notice: Subject to any disclaimer, the term of this patent is extended or adjusted under 35 U.S.C. 154(b) by 1477 days.

(21) Appl. No.: 10/559,095

(22) PCT Filed: May 8, 2004

(86) PCT No.: PCT/EP2004/004932

§ 371 (c)(1),
(2), (4) Date: Dec. 1, 2005

(87) PCT Pub. No.: WO2004/105880

PCT Pub. Date: Dec. 9, 2004

(65) Prior Publication Data

US 2006/0117470 A1 Jun. 8, 2006

(30) Foreign Application Priority Data

Jun. 2, 2003 (DE) ..... 103 25 057
Jun. 21, 2003 (DE) ..... 103 27 994

(51) Int. Cl.
*A42B 1/04* (2006.01)

(52) U.S. Cl.
USPC ..... 2/84; 2/901

(58) Field of Classification Search
USPC ..... 2/202, 901, 84, 203, 6.2, 417, 160, 2/161.3, 161.8, 2.1, 68, 182.5, 181.8; 128/201.22–201.25, 206.12, 206.24, 128/201.29, 206.16, 206.23
See application file for complete search history.

(56) References Cited

U.S. PATENT DOCUMENTS

| | | | | | |
|---|---|---|---|---|---|
| 1,237,048 | A | * | 8/1917 | Idoux | 2/181.8 |
| 1,746,427 | A | * | 2/1930 | Howland | 2/68 |
| 2,005,072 | A | | 6/1935 | Booharin | 128/141 |
| 2,086,325 | A | | 7/1937 | Frankel | 2/84 |
| 2,206,402 | A | * | 7/1940 | Howland | 2/68 |
| 2,285,659 | A | * | 6/1942 | Howland | 2/68 |
| 2,285,660 | A | * | 6/1942 | Howland | 2/68 |
| 2,390,462 | A | * | 12/1945 | Rosenberg | 2/70 |
| 2,935,985 | A | * | 5/1960 | Andrews et al. | 128/201.23 |
| 3,026,526 | A | * | 3/1962 | Montrose | 2/68 |
| 3,113,319 | A | * | 12/1963 | Vail | 2/68 |
| 3,359,567 | A | * | 12/1967 | Zemme et al. | 2/457 |
| 3,447,164 | A | * | 6/1969 | Greenhouse | 2/68 |

(Continued)

FOREIGN PATENT DOCUMENTS

| | | | | |
|---|---|---|---|---|
| EP | 0057517 | | 8/1982 | A62B 17/00 |
| EP | 157140 | A1 * | 10/1985 | A41D 13/00 |
| GB | 2078491 | | 1/1982 | |

*Primary Examiner* — Alissa L Hoey
(74) *Attorney, Agent, or Firm* — Woodard Emhardt Moriarty McNett & Henry LLP

(57) ABSTRACT

The invention relates to a hood (1), particularly for a clothing item (2), preferably for protective and/or military purposes, such as an NBC protective garment (suit) or the like, wherein the hood (1) comprises a circumferential (i.e. peripheral) elastic hem (3) for forming a face opening (4), said face opening (4) being provided for receiving a respirator (5), and the hem (3) abutting the respirator (5) in the use state. To achieve or improve the sealing of the transition area between hem (3) and respirator (5), the side of the hem (3) that faces into the face opening (4) is provided with at least one circumferential sealing element (6) for closeout abutment of the respirator (5).

15 Claims, 5 Drawing Sheets

(56) References Cited

U.S. PATENT DOCUMENTS

| | | | | | |
|---|---|---|---|---|---|
| 3,503,076 | A | * | 3/1970 | Marks | 2/68 |
| 3,510,880 | A | * | 5/1970 | Gerson | 2/68 |
| 3,625,206 | A | * | 12/1971 | Charnley | 128/846 |
| 3,996,621 | A | * | 12/1976 | Martienssen | 2/68 |
| 4,146,932 | A | * | 4/1979 | Kalbas | 2/68 |
| 4,174,710 | A | * | 11/1979 | Pampuch | 128/206.24 |
| 4,500,581 | A | | 2/1985 | Mitomi et al. | 428/85 |
| 4,860,382 | A | * | 8/1989 | Markwell | 2/457 |
| 4,932,078 | A | * | 6/1990 | Jones et al. | 2/70 |
| 5,109,549 | A | * | 5/1992 | Mattinson | 2/202 |
| 5,206,958 | A | * | 5/1993 | Widenback | 2/457 |
| 5,245,993 | A | * | 9/1993 | McGrady et al. | 128/201.22 |
| H1360 | H | * | 10/1994 | Grove et al. | 128/201.25 |
| 5,628,065 | A | * | 5/1997 | Austin | 2/81 |
| 5,653,225 | A | | 8/1997 | Schegerin | 128/201.24 |
| 5,680,653 | A | * | 10/1997 | Mathis et al. | 2/123 |
| 5,926,849 | A | * | 7/1999 | Boyle | 2/181.8 |
| 6,006,360 | A | * | 12/1999 | Reed | 2/202 |
| 6,052,825 | A | * | 4/2000 | Dodd | 2/68 |
| 6,088,832 | A | * | 7/2000 | Newman | 2/67 |
| 6,108,815 | A | * | 8/2000 | Majerfeld | 2/71 |
| 6,266,828 | B1 | * | 7/2001 | Corsini | 2/424 |
| 6,286,144 | B1 | * | 9/2001 | Henderson et al. | 2/69 |
| 6,530,090 | B1 | * | 3/2003 | Ambrose et al. | 2/59 |
| 6,578,572 | B2 | * | 6/2003 | Tischer et al. | 128/201.25 |
| 6,826,781 | B2 | * | 12/2004 | Lewis | 2/84 |
| 6,829,784 | B2 | * | 12/2004 | Austin | 2/7 |
| 6,895,960 | B2 | * | 5/2005 | Fabin | 128/201.23 |
| 6,934,969 | B2 | * | 8/2005 | Schorr et al. | 2/51 |
| 6,966,068 | B2 | * | 11/2005 | Johnson et al. | 2/68 |
| 7,017,577 | B2 | * | 3/2006 | Matich | 128/206.14 |
| 7,047,568 | B2 | * | 5/2006 | Hofmann | 2/70 |
| 7,093,302 | B1 | * | 8/2006 | Burns | 2/8.1 |
| 7,155,746 | B2 | * | 1/2007 | Schorr et al. | 2/51 |
| 2002/0092522 | A1 | * | 7/2002 | Fabin | 128/201.23 |
| 2002/0189007 | A1 | * | 12/2002 | Cormier | 2/457 |
| 2003/0033657 | A1 | * | 2/2003 | Austin | 2/81 |
| 2004/0261153 | A1 | * | 12/2004 | Johnson et al. | 2/68 |
| 2005/0044605 | A1 | * | 3/2005 | Hofmann | 2/69 |
| 2005/0115567 | A1 | * | 6/2005 | Bridges et al. | 128/206.21 |
| 2005/0155607 | A1 | * | 7/2005 | Martin et al. | 128/207.13 |
| 2005/0193472 | A1 | * | 9/2005 | Courtney et al. | 2/202 |
| 2005/0247310 | A1 | * | 11/2005 | Grove et al. | 128/201.22 |
| 2006/0107448 | A1 | * | 5/2006 | Brookman | 2/457 |
| 2007/0130676 | A1 | * | 6/2007 | Von Blucher | 2/456 |

* cited by examiner

HOOD FOR PROTECTIVE GARMENT

CROSS-REFERENCE TO RELATED APPLICATIONS

This application is a Nation Stage of International Application PCT/EP2004/004932, filed May 8, 2004. Applicant claims foreign priority benefits under 35 U.S.C. 119(a)-(d) of the following foreign applications of patent: German Application No. 103 25 057.3, filed Jun. 2, 2003, and German Application No. 103 27 994.6, filed Jun. 21, 2003, all of which are hereby incorporated by reference in their entirety.

BACKGROUND OF THE INVENTION

The present invention relates to a hood, in particular for clothing items for protective and/or military purposes, such as NBC protective suits/garments and the like. The present invention further relates to clothing items, in particular for protective and/or military purposes, such as NBC protective suits and the like, which are equipped with such a hood.

Further, the present invention also relates to the use of an elastic hem for closing out the transition between a portion of a clothing item, in particular a hood, on the one hand and a further clothing item or outfit article (equipment article), in particular a respirator, on the other.

Persons who come into contact with poisonous materials which are absorbable via the respiratory tract pathways have to protect themselves against these poisonous materials by wearing a respirator. If, in addition, there is a danger that the poisonous substances can also be taken up or absorbed via the skin or if it is part of their outfit (i.e. equipment), these persons (examples are armed forces personnel, firefighters, police personnel, members of special forces such as GSG 9, etc.) must additionally wear protective clothing, in particular NBC protective suits which prevent any contact of the poisonous materials with the skin or body and are generally equipped with a hood. The hood of such NBC protective suits can have a circumferential (i.e. orbital or peripheral), in particular elastic, hem to form a face opening which is provided to receive a respirator, the hem of the hood being intended to abut the respirator in the use state.

However, this often leads to problems, since the transition between the hood/hem on the one hand and the respirator on the other is in most cases not adequately sealed. Consequently, poisonous or perilous materials can pass through the inadequately sealed transition between hood/hem on the one hand and respirator on the other and consequently the wearer of such a protective suit will come into contact with these materials, or these materials can even pass underneath the rim of the respirator, so that they are finally inhaled. This is particularly perilous for the wearer of such a protective suit when he or she is exposed to skin contact poisons, an example being mustard gas (bis(2-chloroethyl) sulfide, also known as Hd).

The present invention, then, has for its object to provide such a clothing item, preferably for protective and/or military purposes, such as an NBC protective suit or the like, or to be more precise a hood for such a clothing item as at least substantially avoids the problems described above. In particular, the present invention has for its object in relation to such a clothing item and/or in relation to such a hood to engineer the transition between clothing item/hood on the one hand and respirator on the other such that this transition is at least substantially sealed.

This object is achieved as proposed by a hood according to what is disclosed and illustrated herein and by a clothing item according to the disclosed and illustrated invention, respectively. Further, advantageous refinements and executions form part of the subject matter of the disclosed and illustrated invention.

According to a first aspect of the present invention there is accordingly provided a hood, in particular for a clothing item, preferably for protective and/or military purposes, such as an NBC protective suit or the like, the hood comprising a circumferential (i.e. peripheral/orbital) elastic hem to form a face opening, the face opening being provided to receive a respirator and the hem abutting the respirator in the use state, wherein the side of the hem that faces into the face opening (i.e., the side of the hem's face opening which faces toward the respirator in the use state) is provided with at least one circumferential (i.e. peripheral/orbital) sealing element for closeout abutment of the respirator.

One fundamental idea of the present invention is thus to equip the above-described hood's hem which forms the face opening with at least one circumferential (i.e. peripheral/orbital) sealing element on that side of the hem which faces into the face opening, (i.e., on that side of the hem which faces toward the respirator in the use state). The result is that, in the use state, i.e., when the respirator is being worn, sealing of the transition between hood/hem on the one hand and respirator on the other is achieved or significantly improved.

In the use state, i.e., when the respirator is being worn, the sealing element rests on the respirator, creating a leakproof friction-grip connection with the underlying respirator.

The term "circumferential" (i.e. "peripheral"/"orbital" as synonyms) as used herein in relation to the hem and the sealing element is to be understood for the purposes of the present invention not only in its narrow sense but also in a wider sense. Therefore, "circumferential" (i.e. "peripheral"/"orbital") can designate not only a state where the hem or the sealing element form a closed ring or circle, but also a state where the hem and the sealing element has two loose ends (for example when the hood comprises a closure or a closable opening), in which case the two loose ends of the hem and of the sealing element then can be placed on top of one another or be at least essentially brought together at the ends. This too shall for the purposes of the present invention also be understood as subsumed by the term "circumferential" (i.e. "peripheral"/"orbital"). What is decisive is that the circumferential sealing element is at least essentially continuous, i.e., without channels and openings, so that it can abut sealingly against the respirator.

It is particularly advantageous when the sealing element abuts the respirator at least essentially linearly, and/or the sealing element projects and/or protrudes from the hem. The at least essentially linear abutment of the respirator in the use state creates a higher contact pressure and consequently an improved closeout. To achieve an at least essentially linear abutment of the respirator by the sealing element, the sealing element must be appropriately configured.

BRIEF SUMMARY OF THE INVENTION

A hood, in particular for a clothing item, preferably for protective and/or military purposes, such as an NBC protective suit or the like, according to one embodiment of the present invention includes a circumferential (peripheral) elastic hem constructed and arranged to form a facing opening, the face opening being provided so as to receive a respirator and the hem abutting the respirator in the use state, the structure being characterized in that the side of the hem that faces into the face opening is provided with a multiplicity of circumferential sealing elements which are durably conjoined with the hem and are in the form of elastofibers for closeout abutment of the respirator.

Further advantages, properties, aspects and features of the present invention will be apparent from the following description of a preferred operative example depicted in the drawings.

DETAILED DESCRIPTION OF THE INVENTION

Figure 1:
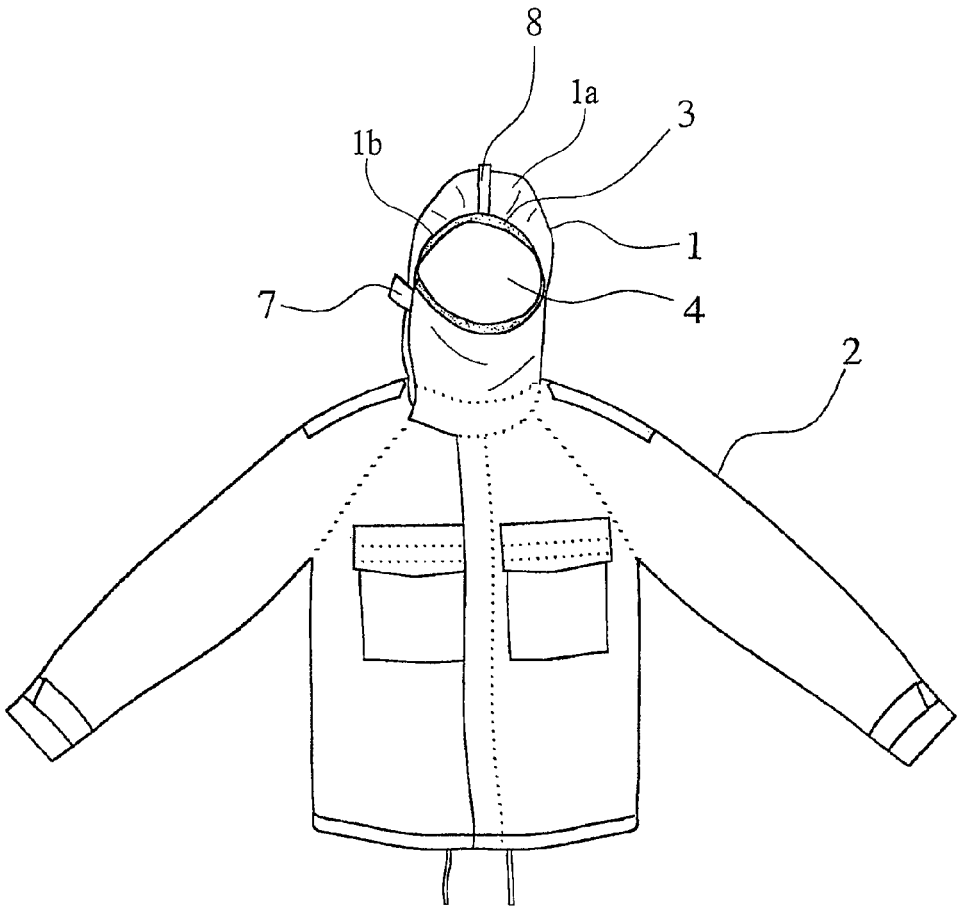
FIG. 1 shows a schematic depiction of an inventive clothing item equipped with an inventive hood.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 shows an inventive clothing item 2, preferably for protective and/or military purposes, such as an NBC protective suit or the like, that is equipped with an inventive hood 1. Hood 1 has a hood body 1*a* with an edge 1*b* defining an opening. A circumferential elastic hem 3 is joined to edge 1*b* to form a face opening 4. As evident from FIG. 2 and FIG. 3A, the face opening 4 is provided to receive a respirator 5. The hem 3 abuts the respirator 5 in the use state.

Figures 3A, 3B:
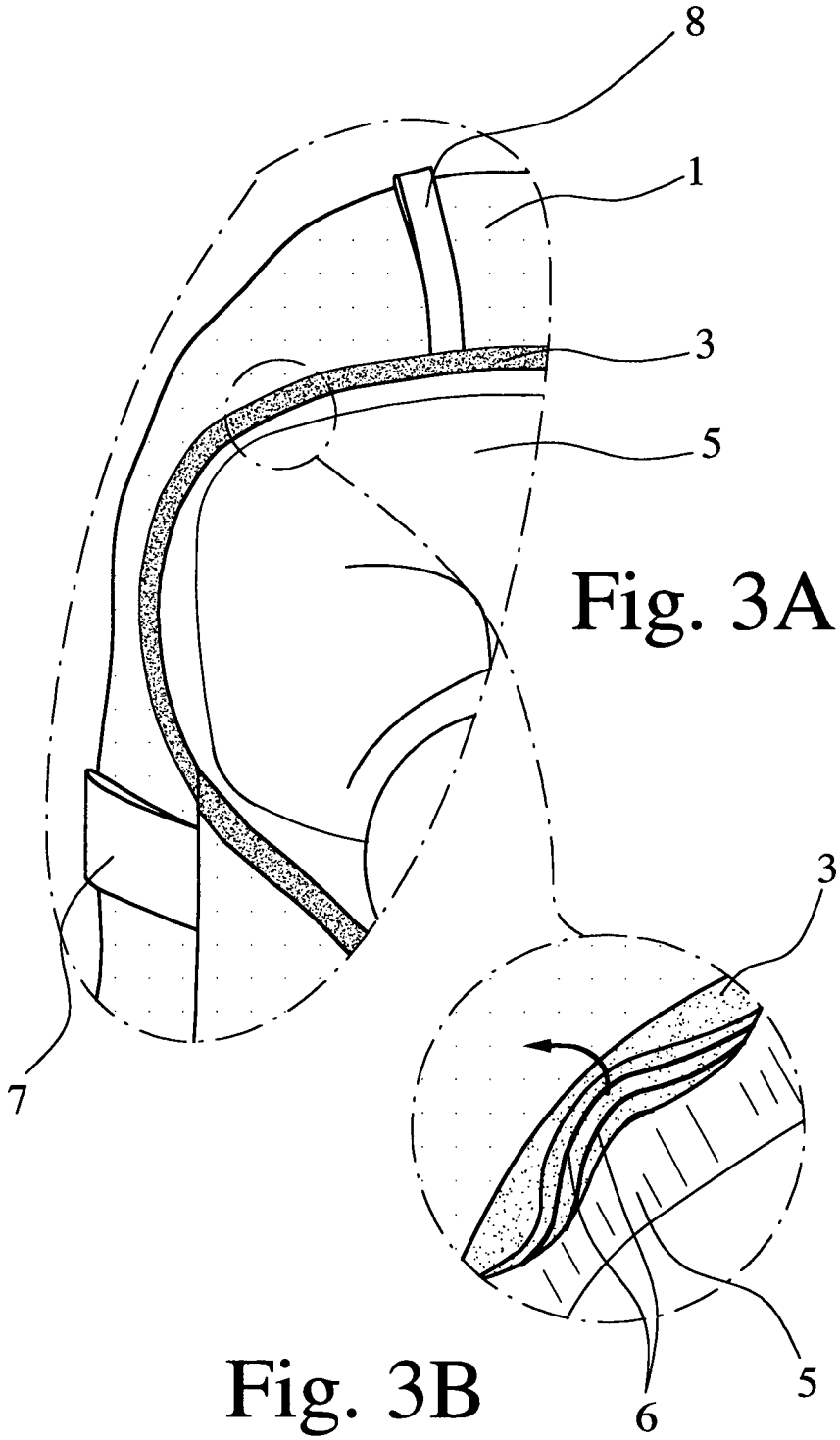
FIG. 3A shows an enlarged depiction of that region of the inventive hood in the use state which is marked in FIG. 2 by broken lines.
FIG. 3B shows an enlarged depiction of the region marked in FIG. 3B by broken lines or of the cutout marked accordingly in FIG. 3A.

FIG. 3B shows the region specially marked in FIG. 3A, as a schematic enlargement, the hem 3 which abuts the respirator 5 being flipped upward in the arrow direction in the depiction of FIG. 3B, revealing the sealing element 6 which, according to the present invention, is provided for closeout abutment of the respirator 5 and which is provided on that side of the hem which faces into the face opening 4 or on that side of the hem which faces the respirator 5 in the use state.

In a particular embodiment, the sealing element 6 provided according to the present invention abuts the respirator 5 at least essentially linearly. It is appropriately configured for this purpose, as FIG. 3B shows. The advantages of the at least essentially linear abutment were described above in the general descriptive part.

Figure 5:
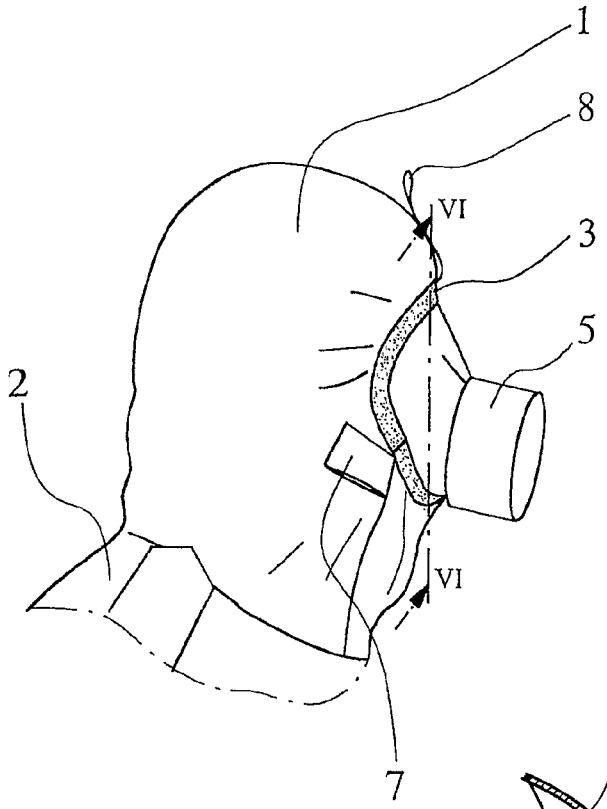
FIG. 5 shows a side view of the inventive hood in the use state.
Figure 6:
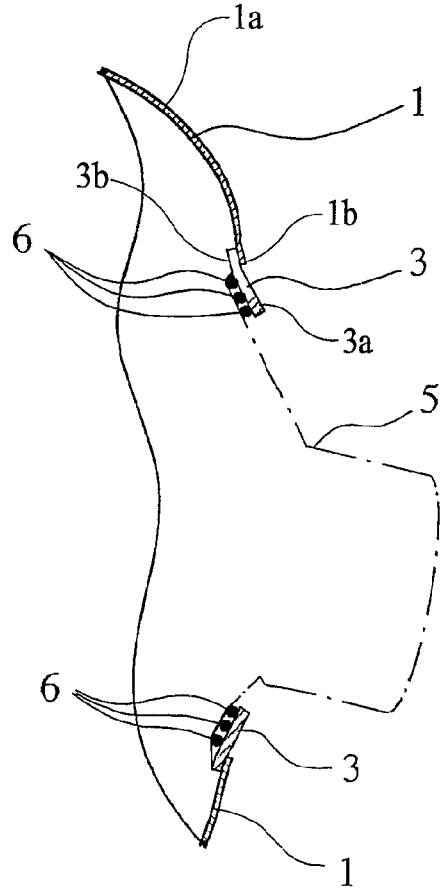
FIG. 6 shows an enlarged cross-sectional depiction along the line VI depicted in FIG. 5.

The functioning of the sealing element 6 which is provided according to the present invention is illustrated in FIG. 6 in conjunction with FIG. 5. FIG. 6 is an enlarged cross-sectional depiction along the broken line VI depicted in FIG. 5. As can be seen from FIG. 6, in the use state, i.e., when a respirator 5 is being worn, the sealing elements 6 abut the respirator 5 at least essentially linearly together with the hem 3, the hem 3 pressing the sealing elements 6 against the respirator 5. The at least essentially linear abutment of the sealing elements 6 significantly increases the contact pressure and ensures excellent closeout. With continued reference to FIG. 6 it will be seen that the hem 3 has an outer face 3*a* and an inner face 3*b*. The sealing elements 6 are joined to the inner face 3*b* of hem 3 and in combination with hem 3 abut up against the respirator 5.

Figure 4A:
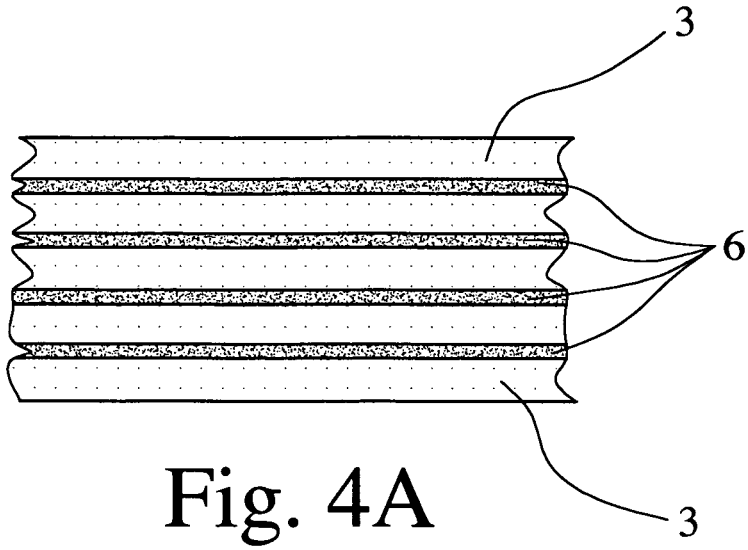
FIG. 4A shows a schematic plan view of the hem equipped according to the present invention with sealing elements.

As evident from FIG. 4A, it can be advantageous to provide a plurality of sealing elements 6 on the hem 3, preferably at least two sealing elements 6. Various configurations with regard to the arrangement of the sealing elements are possible in such a case. As FIG. 4A shows, the individual sealing elements 6 may be in an at least essentially parallel arrangement. In addition, it is also possible, for example, to arrange the individual sealing elements in such a way that they form a honeycomblike construction (not depicted). What is decisive is solely that a leakproof connection between hem 3 and respirator 5 is achieved in the use state.

As cross-sectional depictions 4B and 4C show, the sealing element 6 may project and/or protrude from the hem 3. This, instead of a two-dimensional abutment, provides an essentially linear abutment in the use state, which is associated with a higher contact pressure and with a higher closeout.

The sealing element 6 provided according to the present invention is in particular configured as a sealing ring, as a sealing lip or as a sealing protrusion. In general, this creates an elevation or uprising on the hem 3.

Figure 4B:
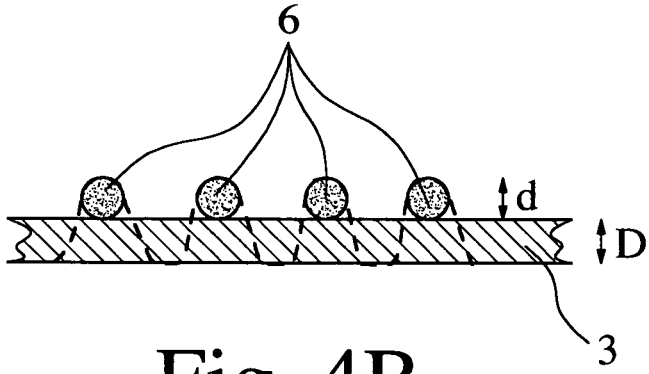
FIG. 4B show a schematic cross section through a hem according to one embodiment which is equipped according to the present invention with sealing elements.
Figure 4C:
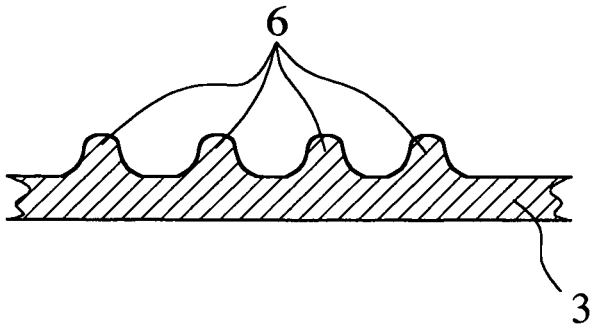
FIG. 4C shows a schematic cross section through a hem according to another embodiment which is equipped according to the present invention with sealing elements.

The sealing element 6 may be secured to the hem 3, in particular durably joined to the hem 3, preferably by stitching, interweaving, adhering, stapling, welding or the like; such an embodiment is depicted in FIG. 4B. In another embodiment, the sealing element 6 may however also be part of the hem 3, in particular the sealing element 6 and the hem 3 may be configured as a one-piece structure; such an embodiment is depicted in FIG. 4C.

The sealing element provided according to the present invention may be thread, ligament, string or strip shaped or else webbed or else honeycomb shaped.

In general, the sealing element 6 consists of an elastically deformable material. Care should be taken in particular to ensure that the elasticity of the sealing element 6 corresponds at least essentially to the elasticity of the hem 3 or even exceeds it.

In a particular embodiment of the present invention the sealing element 6 has a relative elastic extensibility or extension, based on its original length, of not less than 20%, in particular not less than 30%, preferably not less than 50%, more preferably not less than 70% and even more preferably not less than 85% or more. In a particular embodiment of the present invention the 25° C. modulus of elasticity in stretching of the material of which the sealing element 6 consists is not more than $10^8$ $N \cdot m^{-2}$, in particular not more than $10^7$ $N \cdot m^{-2}$, preferably not more than $5 \cdot 10^6$ $N \cdot m^{-2}$, and is preferably in the range from $5 \cdot 10^5$ $N \cdot m^{-2}$ to $9 \cdot 10^6$ $N \cdot m^{-2}$.

In a further embodiment of the present invention it may be advantageous when the FIG. 4B cross-sectional thickness d of the sealing element 6 is not less than ¼, in particular not less than ⅓, preferably not less than ⅔ and more preferably not less than ¾ of the FIG. 4B cross-sectional thickness D of the hem 3. In particular, the sealing element 6 should project and/or protrude from the hem 3 by not less than 0.1 mm, in particular not less than 0.25 mm, preferably not less than 0.4 mm, more preferably not less than 0.6 mm and even more preferably to an extent of 1 mm or more. A particularly good sealing effect can be achieved as a result.

The material of which the sealing element 6 which is provided according to the present invention consists may be for example any kind of gum, latex, elastic plastic, etc., as long as it is suitable for use in the realm of the present invention. In particular, these materials should advantageously have a certain thermal and UV stability and also, what is more, a certain resistance to aggressive media, in particular warfare agents, but also to body fluids, in particular sweat. It is also of advantage for the material to be water repellent.

Examples of materials suitable according to the present invention are for example certain kinds of so-called elastofibers (see RÖMPP-Chemielexikon, 10th edition, volume 2, 1997, pages 1104 to 1106, headword "Elastofasern", Georg Thieme Verlag Stuttgart/New York); elastofibers are manufactured fibers which are extremely extensible and, after the tensile force has been removed, substantially return into the original state. The most important representatives are elastane, fibers composed of high polymers which consist to at least 85% by weight of segmented polyurethane, and elastodiene, fibers which consist of synthetic polyisoprene or of high polymers formed by polymerization of one or more dienes with or without one or more vinyl monomers. The second group may also be considered as including the elastomeric fibers formed from natural rubber. Elastodienes are frequently vulcanized. Elastic properties are also possessed by a bicomponent fiber consisting of polyamide and polyurethane. See the aforementioned literature reference for further details. The dimensions of such fibers must be appropriately adapted for the purposes of the present invention. Such fibers can be incorporated with the hem material for example.

Figure 2:
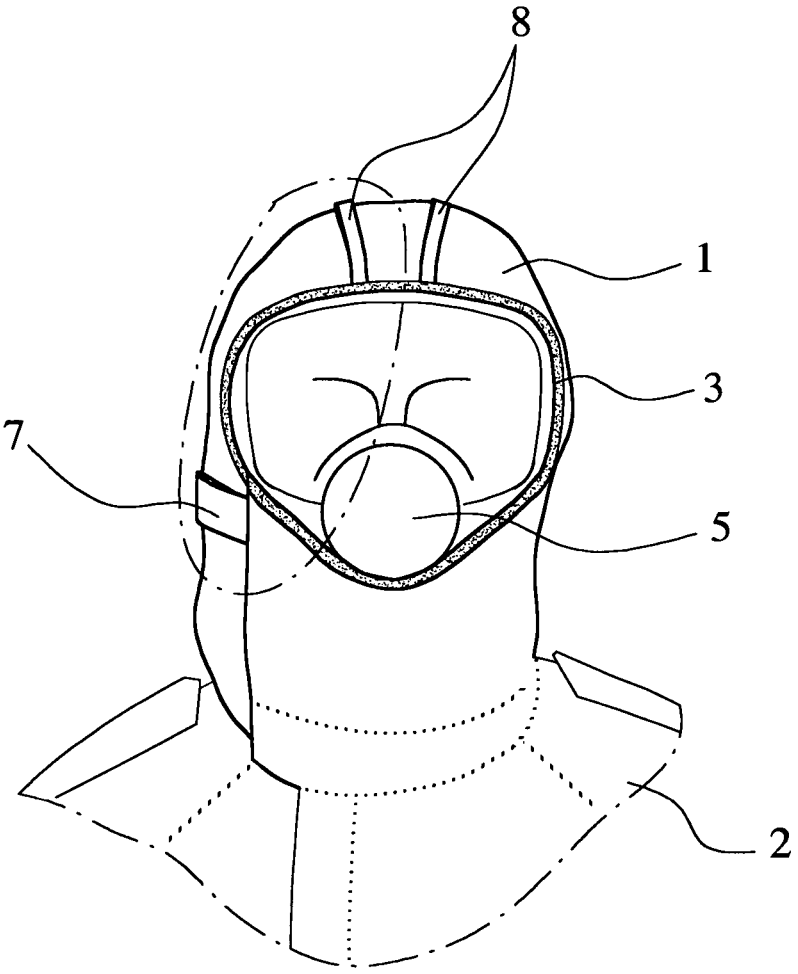
FIG. 2 shows a schematic depiction of an inventive hood in the use state.

As depicted in FIG. 1 and FIG. 2 for example, the present invention's hood 1 including the face opening 4 may comprise, in particular on the side portion of the face opening 4, a fastener 7, for example in the form of a touch and close fastener or zip fastener. A fastener makes it easier to put on the respirator and also enhances the wear comfort, since the hood can be opened in situations where the respirator is not needed. But it should be ensured that the hood fastener 7 is at least essentially tightly closable. In principle, the fastener 7 can be disposed at any desired location of the face opening 4, for example laterally but also centrally with regard to the face opening 4; in practice, however, it will be found advantageous in particular for reasons of practicability, wear comfort and superior sealability for the fastener 7 to be situated on the side portion of the face opening 4.

The hood 1 may be made detachable from the rest of clothing item 2, for example via a touch and close fastener or a zip fastener; with this embodiment too care must be taken to ensure that the rest of clothing item 2 and the hood 1 are at least essentially tightly conjoinable with one another. It is similarly possible for the hood 1 to be part of clothing item 2, in particular to be stitched thereto or even form a one-piece construction therewith.

In a further embodiment it may be provided, as depicted in FIG. 1 and FIG. 2 for example, that the present invention's hood 1 comprises at least one loop, tab or the like 8 above the face opening 4. This makes it possible in particular to adjust the face opening 4 and/or the hood 1, in particular when the hood 1 is being worn in conjunction with a helmet or some other head covering on top of the hood 1.

To enable poisonous materials, in particular warfare agents, to strike through the hood 1 and/or, alternatively, to ensure removal of any poisonous materials which have succeeded in penetrating into the hood 1, it may be provided that the hood 1 is fully or partially lined on its inside surface with an inside material (i.e., a liner) which comprises an adsorption-capable material, in particular activated carbon, for example in the form of activated carbon granules or spherules or activated carbon fibers. Alternatively or in combination with such an adsorption-capable material it may be provided that the inside material comprises a water vapor pervious, at least essentially gas and/or air impervious barrier layer which prevents or at least retards the passage of harmful gases or liquids, in particular chemical warfare agents. Such inside materials, which are endowed with an absorptive layer and/or a barrier layer, are known as such from the prior art. Reference may be made in this regard for example to DE 198 29 975 A1, DE 39 39 373 A1, DE 38 15 720 A1, DE 195 19 869 A1, DE 198 42 274 A1 and DE 102 40 548, whose respective disclosure contents are hereby incorporated herein by reference.

In a particular embodiment the entire clothing item 2 may be wholly or partly equipped with such an inside material.

The present invention accordingly further provides a clothing item, in particular for protective and/or military purposes, such as an NBC protective suit or the like, as classified in the claims. The above observations relating to the hood of the present invention and to the clothing item of the present invention respectively apply accordingly.

The present invention accordingly also provides a clothing item, in particular for protective and/or military purposes, such as an NBC protective suit or the like, the clothing item comprising at least one opening for a body part (for example a hand, arm, foot, leg or head) having a circumferential elastic hem to form this opening, the opening being provided to receive a further clothing item in particular having a smooth surface texture (for example a protective glove etc.) and/or to receive an outfit article (i.e. piece of equipment, for example a respirator etc.) and the hem abutting the further clothing item and/or the outfit article (piece of equipment) in the use state, wherein the side of the hem that faces the further clothing item and/or the outfit article (i.e. the piece of equipment) in the use state, preferably the side of the hem which faces into the opening, is provided with at least one circumferential sealing element for closeout abutment of the further clothing item and/or outfit article (equipment article). For further details reference may be made to the above observations with regard to the hood of the present invention and with regard to the clothing item of the present invention respectively, which apply here accordingly.

It is thus a further fundamental idea of the present invention to close out the transition between the openings provided in clothing items for body parts, on the one hand, and further clothing items or outfit articles (equipment articles), on the other, by the corresponding opening having been provided with a hem which comprises at least one sealing element of the above-described kind on the appropriate side.

The present invention finally further provides for the use of an elastic hem for closing out the transition between a portion of a clothing item, in particular a hood, on the one hand and a further clothing item and/or outfit article (equipment article), in particular a respirator, on the other, wherein the side of the hem that faces the further clothing item and/or outfit article (equipment article) is provided with at least one circumferential sealing element for closeout abutment of the further clothing item and/or outfit article (equipment article). The observations with regard to the hood of the present invention and with regard to the clothing item of the present invention, respectively, apply accordingly with regard to the use according to the present invention.

Further refinements, modifications and variations of the present invention will be readily apparent to and realizable by the ordinarily skilled after reading the present description without their having to depart from the realm of the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A hood, in particular for a clothing item for protective and military purposes, such as an NBC protective suit, said hood comprising:

a hood body having a peripheral edge defining a face opening, said face opening being constructed and arranged for receiving a respirator;

a peripheral elastic hem attached to said peripheral edge, said peripheral elastic hem being constructed and arranged to extend around said face opening, said peripheral elastic hem having an inner face and an outer face; and a plurality of peripheral sealing elements conjoined to the inner face of said peripheral elastic hem, said plurality of peripheral sealing elements comprised of elastofibers and being constructed and arranged for closeout abutment against and around the respirator received by said face opening, wherein the individual sealing elements are in substantially parallel arrangement with each other, wherein the sealing elements abut the respirator linearly, and wherein the sealing elements project or protrude from the hem.

2. The hood according to claim 1, wherein the sealing elements project or protrude from the hem by not less than 0.25 mm, preferably not less than 0.4 mm.

3. The hood according to claim 1, wherein the sealing elements are secured to the hem by using one of the securing methodologies selected from the group consisting of stitching, interweaving, adhering, stapling and welding.

4. The hood according to claim 1, wherein the sealing elements are each configured as one of the forms selected from the group consisting of a sealing ring, as a sealing lip or as a sealing protrusion.

5. The hood according to claim 1, wherein the sealing elements are constructed and arranged as one of the structures selected from the group consisting of thread-shaped, ligament-shaped, string-shaped, strip-shaped, web-shaped and honeycomb-shaped.

6. The hood according to claim 1, wherein the cross-sectional thickness of the sealing elements is not less than ¼of the cross-sectional thickness of the hem.

7. The hood according to claim 1, wherein the elasticity of the sealing elements corresponds at least essentially to the elasticity of the hem.

8. The hood according to claim 1, wherein the sealing elements have a relative elastic extensibility, based on their original length, of not less than 30%.

9. The hood according to claim 1, wherein the material of which the sealing elements consist has, at 25° C., a modulus of elasticity in stretching in the range of from $5 \cdot 10^5$ $N \cdot m^{-2}$ to $9 \cdot 10^6$ $N \cdot m^{-2}$.

10. The hood according to claim 1, wherein the hood including the face opening comprises, on the side portion of face opening, a fastener.

11. The hood according to claim 1, wherein the hood includes a liner on its inside surface with an inside material, the inside material comprising a material selected from the group consisting of: (i) an adsorption-capable material on the basis of activated carbon, and (ii) a water-vapor-pervious, but gas-impervious barrier layer preventing or retarding the passage of harmful gases and liquids.

12. A clothing item, in particular for protective and/or military purposes, such as an NBC protective suit or the like, comprising a hood as defined in claim 1.

13. The clothing item according to claim 12, wherein the clothing item includes a liner on its inside surface with an inside material, the inside material comprising a material selected from the group consisting of: (i) an adsorption-capable material on the basis of activated carbon, and (ii) a water-vapor-pervious, but gas-impervious barrier layer preventing or retarding the passage of harmful gases and liquids.

14. A clothing item, in particular for protective and military purposes, such as an NBC protective suit or the like, said clothing item comprising:

a clothing body defining at least one opening for a body part, such as a hand, arm, foot, leg or head;

a peripheral elastic hem attached to said clothing body, said peripheral elastic hem being constructed and arranged to extend around said opening, the opening being provided for receiving a further clothing item or an equipment article, said peripheral elastic hem having an inner face and an outer face; and a plurality of peripheral sealing elements which are conjoined to the inner face of said peripheral elastic hem, said plurality of peripheral sealing elements comprised of elastofibers and being constructed and arranged for closeout abutment against and around the further clothing item or equipment article, wherein the individual sealing elements are in substantially parallel arrangement with each other, wherein the sealing elements abut the respirator linearly, and wherein the sealing elements project or protrude from the hem.

15. A method for closing out the transition between a portion of a clothing item on the one hand and a further clothing item or equipment article on the other hand by using an elastic hem, comprising the steps of:

providing an elastic hem having an inner face and an outer face;

joining said elastic hem to said clothing item wherein said elastic hem faces the further clothing item or the equipment article;

providing a plurality of sealing elements in the form of elastofibers; and conjoining said plurality of sealing elements with the inner face of said hem for closeout abutment of the further clothing item or equipment article.

* * * * *